US008107828B2

(12) United States Patent
Yamada et al.

(10) Patent No.: US 8,107,828 B2
(45) Date of Patent: Jan. 31, 2012

(54) IMAGE FORMING APPARATUS AND METHOD

(75) Inventors: Tatsutoshi Yamada, Chiyoda-ku (JP); Kazuo Okunishi, Chiyoda-ku (JP); Masaharu Hashizume, Chiyoda-ku (JP); Hideo Mae, Chiyoda-ku (JP); Masayuki Inoue, Chiyoda-ku (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 761 days.

(21) Appl. No.: 12/173,295

(22) Filed: Jul. 15, 2008

(65) Prior Publication Data

US 2009/0028583 A1 Jan. 29, 2009

(30) Foreign Application Priority Data

Jul. 17, 2007 (JP) ..... 2007-185965

(51) Int. Cl.
*G03G 15/00* (2006.01)
*G03G 15/08* (2006.01)

(52) U.S. Cl. ..... 399/12; 399/27

(58) Field of Classification Search ..... 399/9, 13, 399/24, 25, 27

See application file for complete search history.

(56) References Cited

U.S. PATENT DOCUMENTS 7,221,467 B2 5/2007 Hayashi et al.

FOREIGN PATENT DOCUMENTS

| | | | |
|---|---|---|---|
| JP | 6-149508 | A | 5/1994 |
| JP | 10-105021 | A | 4/1998 |
| JP | 10-198236 | A | 7/1998 |
| JP | 2002-162871 | | 6/2002 |
| JP | 2002-169427 | A | 6/2002 |
| JP | 2003-186369 | | 7/2003 |

OTHER PUBLICATIONS

Notice of Preliminary Rejection in JP 2007-185965 dated Jun. 9, 2009, and an English Translation thereof.

Notice of Preliminary Rejection issued in the corresponding Japanese Patent Application No. 2007-185965 dated Nov. 24, 2009, and an English Translation thereof.

*Primary Examiner* — David Gray
*Assistant Examiner* — Gregory H Curran
(74) *Attorney, Agent, or Firm* — Buchanan Ingersoll & Rooney PC

(57) ABSTRACT

Time required for setting a print mode in a print standby state is shortened, in performing recovering operation. In an attachment state of consumable units on an image forming apparatus, information of the consumable unit memorized in nonvolatile memories of consumable units is memorized in a second nonvolatile memory, and after the print mode is set in an unprintable state, recovering operation having possibility of replacing the consumable units is performed. Thereafter, whether the same consumable units as those before the unprintable state are attached to the image forming apparatus is determined. At this time, a signal based on the information of the consumable units memorized in the nonvolatile memory is transmitted to a bus connected to a plurality of nonvolatile memories, and when there is a reply of a part of the information in the nonvolatile memories to this transmission, it is determined that the same consumable units as those before the unprintable state are attached to the image forming apparatus.

8 Claims, 19 Drawing Sheets

*Fig.17*

| ST | D7 | D6 | D5 | D4 | D3 | D2 | D1 | D0 | PR | SP |
|---|---|---|---|---|---|---|---|---|---|---|

ST : START BIT
D7～D0 : CHARACTER BIT
PR : PARITY BIT (VERTICAL PARITY → PARITY ADDED BY CHARACTER UNIT)
SP : STOP BIT

DATA IS DIVIDED BY CHARACTER UNIT. START BIT IS ARRANGED AT HEAD AND PARITY BIT AND STOP BIT ARE ARRANGED AT END TO PERFORM SYNCHRONOUS COMMUNICATION

*Fig.18*

| TRANSMISSION DATA | A | B | C | D | E | HORIZONTAL PARITY |
|---|---|---|---|---|---|---|
| D 7 | 1 | 1 | 1 | 1 | 1 | 1 |
| D 6 | 0 | 0 | 0 | 0 | 0 | 0 |
| D 5 | 0 | 1 | 0 | 0 | 0 | 1 |
| D 4 | 0 | 0 | 0 | 0 | 0 | 0 |
| D 3 | 0 | 0 | 0 | 1 | 1 | 0 |
| D 2 | 0 | 1 | 0 | 0 | 0 | 1 |
| D 1 | 0 | 0 | 1 | 0 | 1 | 0 |
| D 0 | 1 | 0 | 0 | 0 | 0 | 1 |
| P R | 0 | 1 | 0 | 0 | 1 | 0 |

SYSTEM TO LOAD PARITY BIT IN THE HORIZONTAL DIRECTION (FOR EACH BIT DIGIT) CALCULATED BY EXCLUSIVE OR (IN CASE OF EVEN PARITY)

Fig.19

| | NAME | FIRST BYTE | SECOND BYTE | REMARKS |
|---|---|---|---|---|
| COMMAND | RESET | 10100000 | 10100000 | |
| | ID READING | 10000000 | 00000xxx | *1 |
| | ID DESIGNATION | 10001000 | 00001000 | |
| | TOTAL READING | 10010000 | 00000xxx | *1 |
| | SECTOR READING (LOWER ORDER) | 10011000 | 0xxx0xxx | *1 *2 |
| | SECTOR READING (UPPER ORDER) | 10011001 | 0xxx0xxx | *1 *3 |
| | | | | |
| REPORT | ID REPORT | 11000000 | 00000xxx | *1 |
| | RECEPTION OF ID DESIGNATION | 11000001 | 00001000 | |
| | ID RECEPTION | 11000010 | 00001000 | |
| | | | | |

*1 UNIT IS DESIGNATED BY LOWER ORDER 3-BIT

000 Y-DEVELOPING UNIT
001 M-DEVELOPING UNIT
010 C-DEVELOPING UNIT
011 K-DEVELOPING UNIT
100 Y TONER CARTRIDGE
101 M TONER CARTRIDGE
110 C TONER CARTRIDGE
111 K TONER CARTRIDGE

*2 SECTOR IS DESIGNATED BY UPPER ORDER 3-BIT

| | |
|---|---|
| 000 | 0 |
| 001 | 1 |
| 010 | 2 |
| 011 | 3 |
| 100 | 4 |
| 101 | 5 |
| 110 | 6 |
| 111 | 7 |

*3 SECTOR IS DESIGNATED BY UPPER ORDER 3-BIT

| | |
|---|---|
| 000 | 8 |
| 001 | 9 |
| 010 | 10 |
| 011 | 11 |
| 100 | 12 |
| 101 | 13 |
| 110 | 14 |
| 111 | 15 |

Fig.20

| SECTOR | HEAD ADDRESS | | | | | | | | |
|---|---|---|---|---|---|---|---|---|---|
| 0 | 0 | UNIT ID (1) | UNIT ID (2) | UNIT ID (3) | UNIT ID (4) | UNIT ID (5) | UNIT ID (6) | UNIT ID (7) | UNIT ID (8) |
| 1 | 8 | MODEL | UNIT IDENTIFICATION | COLOR IDENTIFICATION | | | DESTINATION (1) | DESTINATION (2) | DESTINATION (3) |
| 2 | 16 | | | | | | | | |
| 3 | 24 | | | | | | | | |
| 4 | 32 | | | | | | | | |
| 5 | 40 | | | | | | | | |
| 6 | 48 | | | | | | | | |
| 7 | 56 | | | | | | | | |
| 8 | 64 | NEW/OLD UNIT INFORMATION | SENSOR ADJUSTMENT VOLTAGE | | | LIFE COUNTER 1 | LIFE COUNTER 2 | | |
| 9 | 72 | | | | | | | | |
| 10 | 80 | | | | | | | | |
| 11 | 88 | | | | | | | | |
| 12 | 96 | | | | | | | | |
| 13 | 104 | | | | | | | | |
| 14 | 112 | | | | | | | | |
| 15 | 120 | | | | | | | | |

Fig.21

| ADDRESS | CONTENTS |
|---|---|
| 0 | |
| 2 | |
| 4 | PRINT OPERATION TIME |
| 6 | |
| | ▪ |
| | ▪ |
| | ▪ |
| 40 | Y-COLOR COUNTER |
| 44 | M-COLOR COUNTER |
| 48 | C-COLOR COUNTER |
| 52 | K-COLOR COUNTER |
| 56 | ▪ |
| | ▪ |
| | ▪ |
| 100 | Y-COLOR ID |
| 108 | M-COLOR ID |
| 116 | C-COLOR ID |
| 124 | K-COLOR ID |
| | ▪ |
| | ▪ |
| | ▪ |
| | ▪ |
| 1023 | ▪ |

IMAGE FORMING APPARATUS AND METHOD

FIELD OF THE INVENTION

The present invention relates to an electrophotographic image forming apparatus, such as a copying machine, a printing machine, a facsimile machine, and a multifunction peripheral including functions of those machines in combination and to an image forming method using such image forming apparatus.

BACKGROUND OF THE INVENTION

There has been proposed an electrophotographic image forming apparatus in which one or more consumable units such as imaging unit and/or toner cartridge are detachably mounted on the apparatus.

Typically, the consumable unit has a nonvolatile memory, for example, which memorizes various information such as identification thereof. When the consumable unit is mounted on the image forming apparatus, the identification memorized in the nonvolatile memory is retrieved into a control of the apparatus. The control has a memory such as nonvolatile memory where the identification or identification information is memorized.

When the consumable unit is replaced and then any recovery action is performed such as turning on the power switch, clearing the power saving mode, or closing the operational door of the apparatus, the control of the apparatus performs operations indicated in FIG. 22, for example.

As shown in FIG. 22, when the recovery action is started, the identification information of the newly mounted consumable unit is retrieved (step S201) and read (step S202). Using the read identification information, it is determined whether the dismounted consumable unit is remounted in the image forming apparatus (step S203). If it is determined that a new consumable unit is mounted, the information in the nonvolatile memory of the consumable unit is read (step S204), which is used for the subsequent image adjustment control (step S205). If, on the other hand, it is determined that the same consumable unit is remounted to the image forming apparatus in step S203, the step S204 is not performed and, based on the information of the consumable unit memorized in the nonvolatile memory of the image forming apparatus, the image adjustment control is performed (step S205). A process similar to that of step S203 is disclosed in JP 10-198236 A.

Typically, an inexpensive nonvolatile memory is used for the consumable unit for the economical reason. This causes a delay in communication so that a considerable time is required for retrieving and reading the identification information and for reading data other than the identification information. Also, the nonvolatile memories are connected to the same serial bus, which further delays the communication speed. As a result, the recovering action needs a considerable time during which the apparatus is unable to start the image forming operation.

SUMMARY OF THE INVENTION

Therefore, an object of the present invention is to provide an image forming apparatus and the image forming method, capable of reducing a time required for the apparatus to become a standby state after the after the recovering action.

To solve the above problem, an image forming apparatus according to the present invention includes consumable units detachably mounted in the image forming apparatus; first nonvolatile memories, each of the first nonvolatile memories being disposed in the consumable unit for memorizing various information including identification information of the consumable unit; an information reader which reads information memorized in the first nonvolatile memory when the consumable unit is attached to the image forming apparatus; a second nonvolatile memory connected to the first nonvolatile memories via the same bus for memorizing the information read by the information reader; and an attachment judging part which executes an attachment judging control for judging whether the same consumable unit as that before a print mode is set in an unprintable state, is attached to the image forming apparatus, when recovering operation having possibility of replacing the consumable unit is performed after the print mode is set in the unprintable state, the attachment judging part transmitting to the bus a signal based on the information of the consumable unit memorized in the second nonvolatile memory, and judging that the same consumable unit as that before the print mode is set in the unprintable state is attached to the image forming apparatus, when there is a reply thereto regarding a part of the information in the first nonvolatile memory.

An image forming method according to the present invention includes a memorizing step of memorizing information of a consumable unit memorized in a first nonvolatile memory of the consumable unit, in a second nonvolatile memory of an image forming apparatus, in a state of attaching the consumable unit to the image forming apparatus; a rememorizing step of performing recovering operation having possibility of replacing the consumable unit after a print mode is set in an unprintable state; and an attachment judging step of judging whether the same consumable unit as that before the print mode is set in the unprintable state is attached to the image forming apparatus, after the rememorizing step, wherein in the attachment judging step, a signal based on the information of the consumable unit memorized in the second nonvolatile memory is transmitted to a bus connected to the first nonvolatile memories, and when there is a reply thereto regarding a part of the information in the first nonvolatile memory, judgment is made that the same consumable unit as that before the print mode is set in the unprintable state is attached to the image forming apparatus.

According to the present invention, when the recovering operation is performed after a print mode is set in an unprintable state, a signal based on the information of the consumable unit memorized in a second nonvolatile memory is transmitted to a bus for connecting the second nonvolatile memory and the first nonvolatile memories, and when there is a reply thereto regarding a part of the information in the first nonvolatile memory, it is determined that the same consumable unit as that before the print mode is set in the unprintable state is attached to the image forming apparatus. Therefore, compared to a conventional structure in which a tremendous number of processing is performed before judging an attachment state of the consumable unit, the time required for judging the attachment state can be significantly reduced. This significantly contributes to the shortening of the time required for reaching the standby state.

BRIEF DESCRIPTION OF THE DRAWINGS

FIG. 17 is a view for describing an arrangement of bits of each character;

FIG. 18 is a view for describing a horizontal parity;

FIG. 19 is a view for specifically describing for a character bit;

FIG. 20 is a view showing a specific example of an address of a first nonvolatile memory;

FIG. 21 is a view showing the specific example of the address of a second nonvolatile memory.

DETAILED DESCRIPTION OF THE PREFERRED EMBODIMENTS

Figure 1:
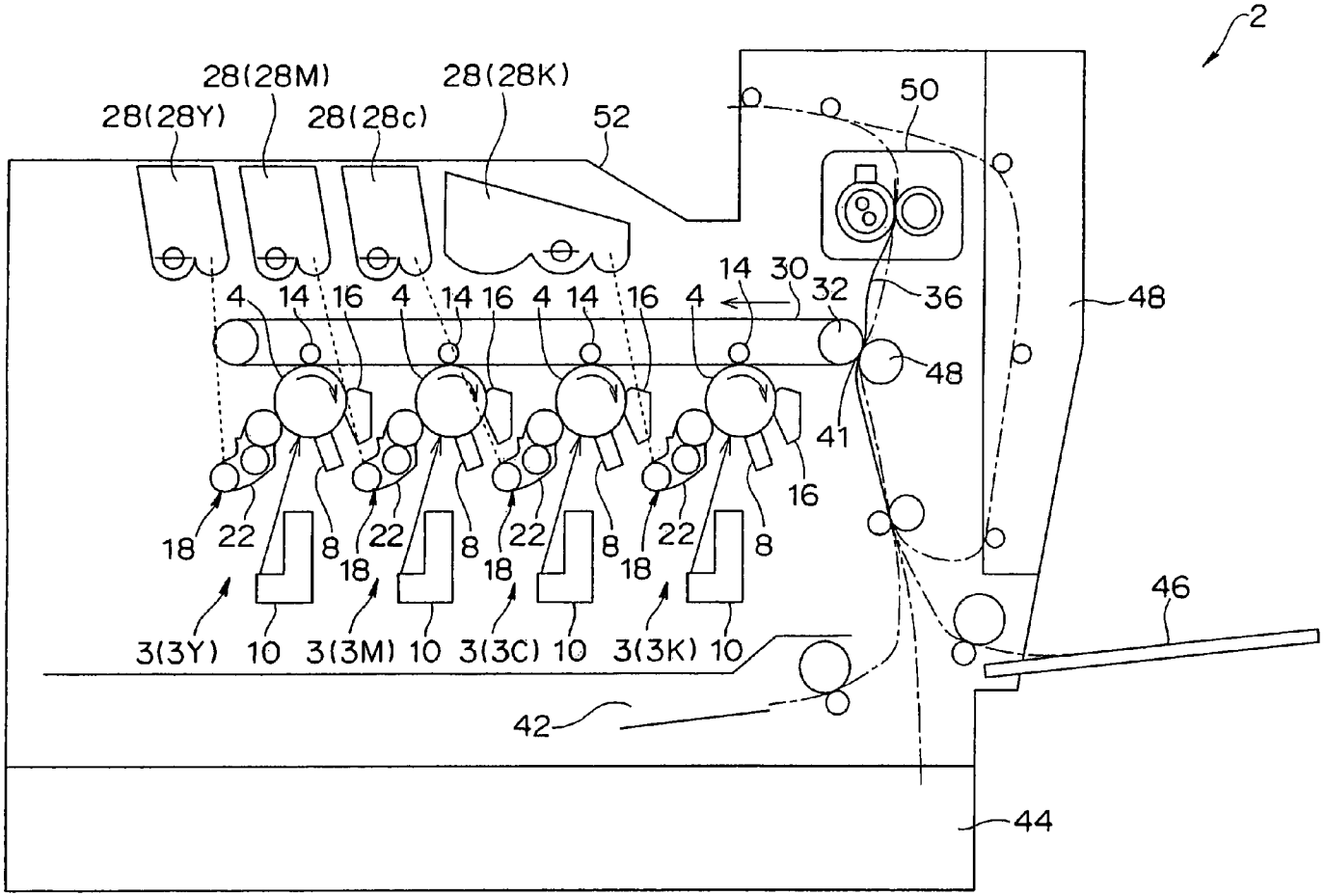
FIG. 1 is a diagram showing a schematic structure of an image forming apparatus according to the present invention.

Preferred embodiments according to the present invention will be described with reference to the accompanying drawings. Although several terminologies that imply specific directions, for example, "upper", "lower", "left", "right", "clockwise", and "counterclockwise", are used in the following description to facilitate the understanding of the present invention with reference to the drawings, it is to be noted that the present invention is not limited by the meanings of such terminologies. In addition, like reference numerals are used for like parts in the description and drawings.

FIG. 1 shows a schematic construction of an image forming apparatus, generally indicated at 2, according to an embodiment of the present invention. The image forming apparatus 2 is an electrophotographic image forming device such as a copy machine, a printing machine, a facsimile machine, and a multi-function peripheral. Among various kinds of electrophotographic image forming apparatuses having been proposed, the image forming apparatus shown in the drawing is a tandem-type color image forming apparatus. However, the present invention is not limited to this image forming apparatus and can be similarly applied to a four-cycle type or a direct transfer-type color image forming apparatus, in which a toner image on an electrostatic latent image bearing member is directly transferred onto a recording sheet. Also, it should be noted that the present invention is equally applied to a black-and-white, i.e., monochrome, image forming apparatus.

The image forming apparatus 2 has an endless, intermediate transfer belt 30. Four image forming units 3 (3Y, 3M, 3C and 3K) for forming toner images with different color developers of yellow (Y), magenta (M), cyan (C) and black (K) are arranged in this order from left to right in the drawing, adjacent a lower belt run of the intermediate transfer belt 30.

The image forming unit 3 has as an electrostatic latent image bearing member, or cylindrical photoreceptor 4. A charging device 8 for charging the outer peripheral surface of the photoreceptor 4, an exposing device 10 for projecting image on the photoreceptor 4 to form an electrostatic latent image, a developing device 18 for supplying each color toner to the photoreceptor 4 to visualize the electrostatic latent image, a primary transfer roller 14 for forcing the immediate transfer belt 30 onto the photoreceptor 4, and a photoreceptor cleaning device 16 are arranged around the photoreceptor 4 sequentially in its rotational direction (i.e., clockwise direction in the drawing).

In this embodiment, the developing unit 18 for development is a consumable unit detachably mounted to the image forming apparatus 2. The developing unit 18 may be constituted so as to be attachable and detachable to/from the image forming apparatus 2 by itself or together with the photoconductor 4 and the other member. The developing units 18 have memories made of, for example, nonvolatile memories 80 (80Y, 80M, 80C, and 80K). Various information including the identification information of the developing unit 18 are memorized in the nonvolatile memories 80. In addition to the identification information, toner concentration sensor adjustment voltage information and service life counter information, for example, can be given as examples of the information memorized in the nonvolatile memories 80. At replacement, the developing unit 18 is attached and detached while opening a front door (not shown) of the apparatus 2. The developing unit 18 has a housing 22 for accommodating developer material made of small particles for development. In this embodiment, the developer material is a two-component developer material including two major components of toner and carrier. Alternatively, a single-component developer material including a major component of toner may be used.

In order to supply the toner into the housing 22 of the developing unit 18, there is provided a toner cartridge 28, for example, in an upper portion of the image forming apparatus 2, so that the housing 22 can be supplied with the toner from the toner cartridge 28 as necessary, according to the consumption of the toner in the housing 22 of the developing unit 18. The ratio (M/N) of toner amount (M) to carrier amount (N) in the housing 22 is maintained to a predetermined value.

The toner cartridge 28 is also a detachable consumable unit. Nonvolatile memories 88 (88Y, 88M, 88C, 88K) are provided in the toner cartridges 28. Various of information including the identification information of the toner cartridge 28 are memorized in the nonvolatile memories 88. In addition to the identification information, toner empty information, toner filling amount information, and toner residual amount information, for example, can be given as examples of the information memorized in the nonvolatile memories 88. At replacement, the toner cartridge 28 is attached and detached to/from the image forming apparatus 2 while opening the front door.

In each image forming unit 3, the toner image formed on the photoconductor 4 is transferred (primary transfer) to a belt 30 from the photoconductor 4 in a nip region (primary transfer region) between the photoconductor 4 and the belt 30. In the primary transfer, toner images of yellow, magenta, cyan, and black are superimposed on the belt 30, thus forming the toner image of full colors.

A secondary transfer roller 40 for nipping and pressing a recording sheet 36 together with the belt 30 is provided outside of a belt portion supported by a roller 32 disposed on the right side in the drawing. The recording sheet 36 is carried from paper feeder 42, 44, or 46 or a reverse unit 48, to the nipping region (secondary transfer region 41) between the secondary transfer roller 40 and the belt 30. In the secondary transfer area 41, the toner image on the belt 30 is transferred (secondary transfer) to the recording sheet 36.

Subsequent to the secondary transfer, the recording sheet 36 is carried to a fixing unit 50 where the toner image is fixed to the recording sheet 36. Finally, the recording sheet 36 is transported onto a paper catch tray 52 formed, for example, on an upper part of the image forming apparatus 2.

Figure 2:
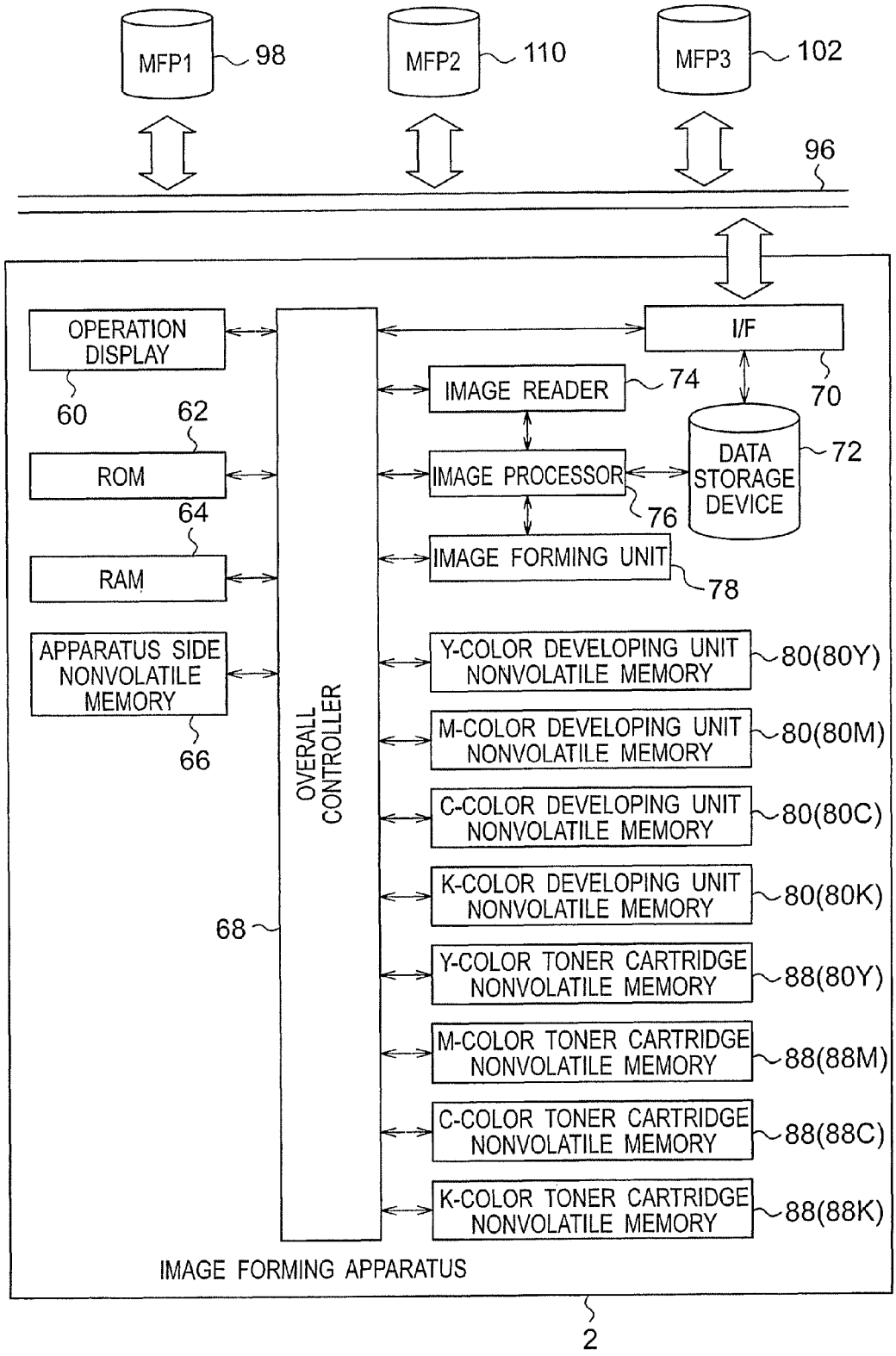
FIG. 2 is a block diagram showing an electric structure of the image forming apparatus.

As shown in FIG. 2, the image forming apparatus 2 has an overall or central controller 68, an ROM 62, an RAM 64, a memory made of nonvolatile memory 66, an interface 70, an image reader 74, an image processor 76, an image forming part 78, a data storage device 72, and an operation display 60.

The overall controller 68 generally controls the image forming apparatus 2, while using the ROM 62 and the RAM 64 as work areas. The nonvolatile memory 66 is used for memorizing a state of the image forming apparatus 2, or total number of images of the consumable unit (developing unit 18 and toner cartridge 28) or counter information such as total operation time. In addition, the identification information read from each developing device 18 and the toner cartridge 28 is memorized in the nonvolatile memory 66. The interface 70 functions as a window for communicating with external equipment such as other image forming apparatuses 98, 100, and 102 via a network 96. The image reader 74 has a function of reading the image and converting the same into the digital data, the image processor 76 has a function of processing the data which is converted into data by the image reader 74, the image forming part 78 has a function of printing the image data processed by the image processor 76, and the data storage device 72 has a function of memorizing the data processed by the image processor 76. The operation display 60 can be operated by users and is capable of displaying various set contents or warnings.

The nonvolatile memory 80 of the developing unit 18 and the nonvolatile memory 88 of the toner cartridge 28 are connected to the overall controller 68.

Figure 3:
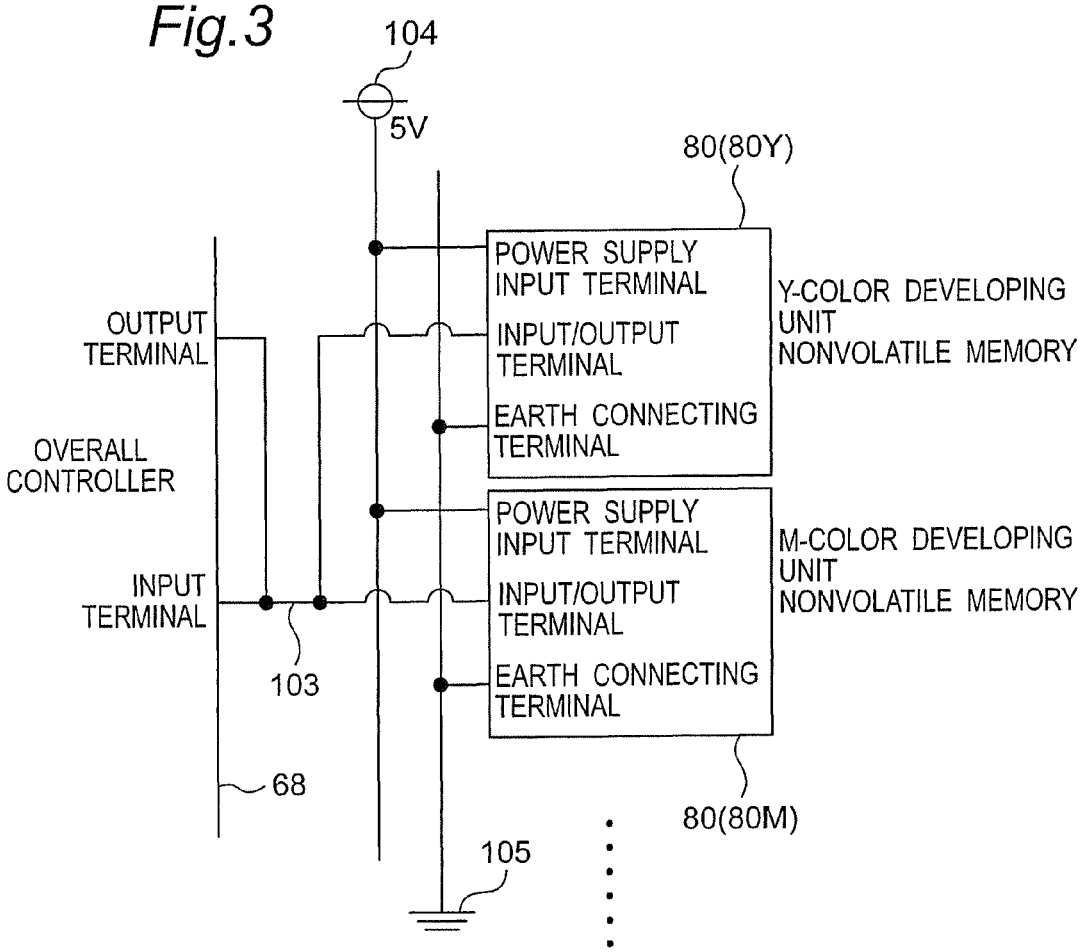
FIG. 3 is a view showing a connection of an overall controller and a nonvolatile memory of the consumable unit.

FIG. 3 shows a specific embodiment of a structure in which the overall controller 68 and the nonvolatile memories 80, 88 are connected to each other. Although FIG. 3 shows only nonvolatile memory 80Y of a yellow developing unit 18Y and nonvolatile memory 80M of a magenta developing unit 18M, nonvolatile memories 80C and 80K of cyan and black developing units 18C and 18K and nonvolatile memory 88 of the toner cartridge 28 of each color are also similarly connected to the overall controller 68.

In the embodiment shown in FIG. 3, the nonvolatile memories 80 and 88 are connected, for example, to a power supply 104 of 5 V, a ground 105, and the overall controller 68. Each of the nonvolatile memories 80 and 88 is connected to the overall controller 68, via the same serial bus 103, and a half duplex start/stop synchronization serial communication such as RS232C is performed between the overall controller 68 and the nonvolatile memories 80, 88. Thus, the number of harnesses can be reduced, and simplification of control can be realized.

In the start/stop synchronization serial communication, the data is divided in a character unit (1 byte unit) shown in FIG. 17. In each character, a start bit is arranged at a head, and a parity bit and a stop bit are arranged at an end, thus making it possible to perform synchronous communication. Eight character bits (D0 to D7) are arranged between the start bit and the parity bit, and each character is constituted of 11 bits in total.

In the embodiment, the data of the nonvolatile memories 80 and 88 of the developing unit 18 or the toner cartridge 28 is read by 8 bytes by the overall controller 68. In such a reading of the data, the nonvolatile memories 80 and 88 transmit a horizontal parity of the data, together with the data of 8 bytes. Meanwhile, the overall controller 68 calculates the horizontal parity by using the received data of 8 bytes, and when a calculated value of the horizontal parity calculated by the overall controller 68 coincides with the calculated value of the horizontal parity transmitted from the nonvolatile memories 80 and 88, reading of the data succeeds. The horizontal parity may be either one of an even parity and an odd parity. As shown in FIG. 18, when the horizontal parity is the even parity, the data of the character bit (D0 to D7) of each character (A to E in the figure) and the parity bit (PR) is totalized for each bit digit, and when the totalized value is the odd number, the horizontal parity is set at 1, and when the totalized value is the even number, the horizontal parity is set at 0.

FIG. 20 shows a memory map of the nonvolatile memories 80 and 88 of the developing unit 18 or the toner cartridge 28. As shown in FIG. 20, the nonvolatile memories 80 and 88 have addresses of the numbers 0 to 127, so that the data of 128 bits can be memorized therein. One sector is constituted by eight addresses in the nonvolatile memories 80 and 88, and for example, sector 0 is constituted by addresses of the numbers 0 to 7, and sector 8 is constituted by addresses of the numbers 64 to 71. Various information is memorized in each address. Specifically, for example, the identification information (8 bytes) of the developing unit 18 or the toner cartridge 28 is divided into eight and memorized in the address of the numbers 0 to 7 of the nonvolatile memories 80 and 88, model information of the image forming apparatus, to which the developing unit 18 or the toner cartridge 28 is attached, is memorized in the address of number 8, unit identification information showing either one of the developing unit 18 and the toner cartridge 28 is memorized in the address of the number 9, color identification information showing the color of the toner of the consumable unit is memorized in the address of the number 10, and destination information (3 bytes) is divided into three and memorized in the addresses of the numbers 13 and 15. In addition, new/old unit information showing whether the developing unit 18 or the toner cartridge 28 is new is memorized in the address of the number 64, sensor adjustment voltage information is memorized in the number 65, and life counter information (2 bytes) is divided into two and memorized in the numbers 68 and 69.

FIG. 21 shows the memory map of the nonvolatile memory 66. As shown in FIG. 21, the nonvolatile memory 66 has the addresses of the numbers 0 to 1023, and is capable of memorizing the data of 1024 bytes. Various information are memorized in each address. Specifically, for example, print operation time can be memorized in address 4 of the nonvolatile memory 66, so that time under one minute can be memorized therein. Addresses 40 to 55 store sheet number counter information of the yellow developing unit 18Y (4 bytes), sheet number counter information of the magenta developing unit 18M (4 bytes), sheet number counter information of the cyan developing unit 18C (4 bytes), and sheet counter information of the black developing unit 18K (4 bytes) respectively, with each of them divided into four addresses. Addresses 100 to 131 store identification information of the yellow developing unit 18Y (8 bytes), identification information of the magenta developing unit 18M (8 bytes), identification information of the cyan developing unit 18C (8 bytes), and identification information of the black developing unit 18K (8 bytes) respectively, with each of them divided into eight addresses.

Figure 4:
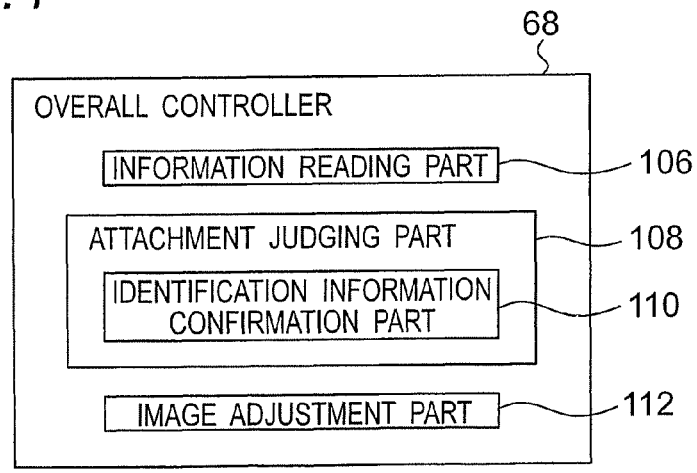
FIG. 4 is a view for describing a structure of the overall controller.

FIG. 4 is a diagram for describing a structure of the overall controller 68. As shown in FIG. 4, the overall controller 68 has an information reader 106, an attachment judging part 108 including an identification information confirmation part 110, and an image adjustment part 112.

The information reader 106 reads the information in the nonvolatile memories 80 and 88 of the developing unit 18 and the toner cartridge 28.

Figure 7:
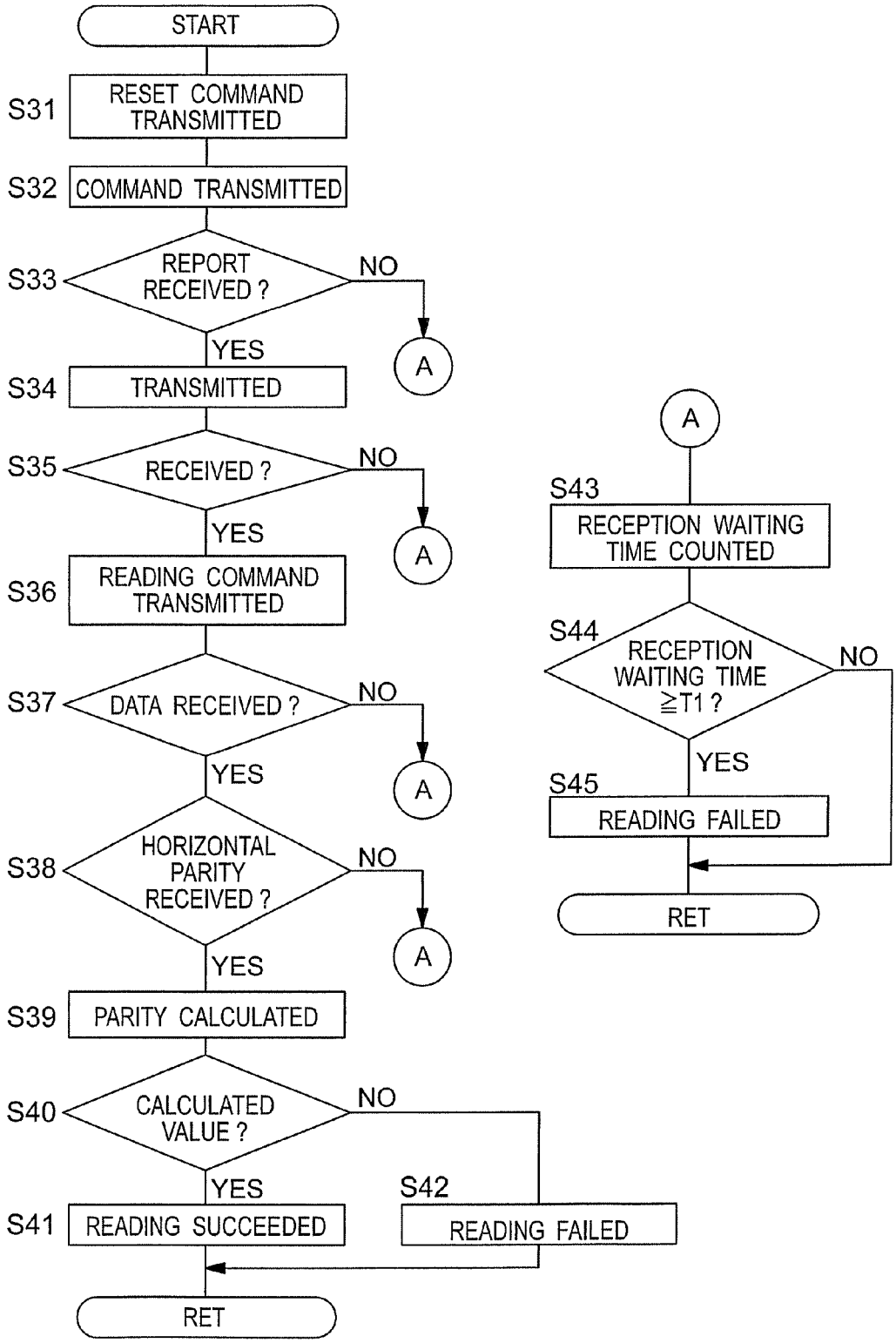
FIG. 7 is a flowchart showing the flow of the processing of identification information confirmation control.
Figure 8:
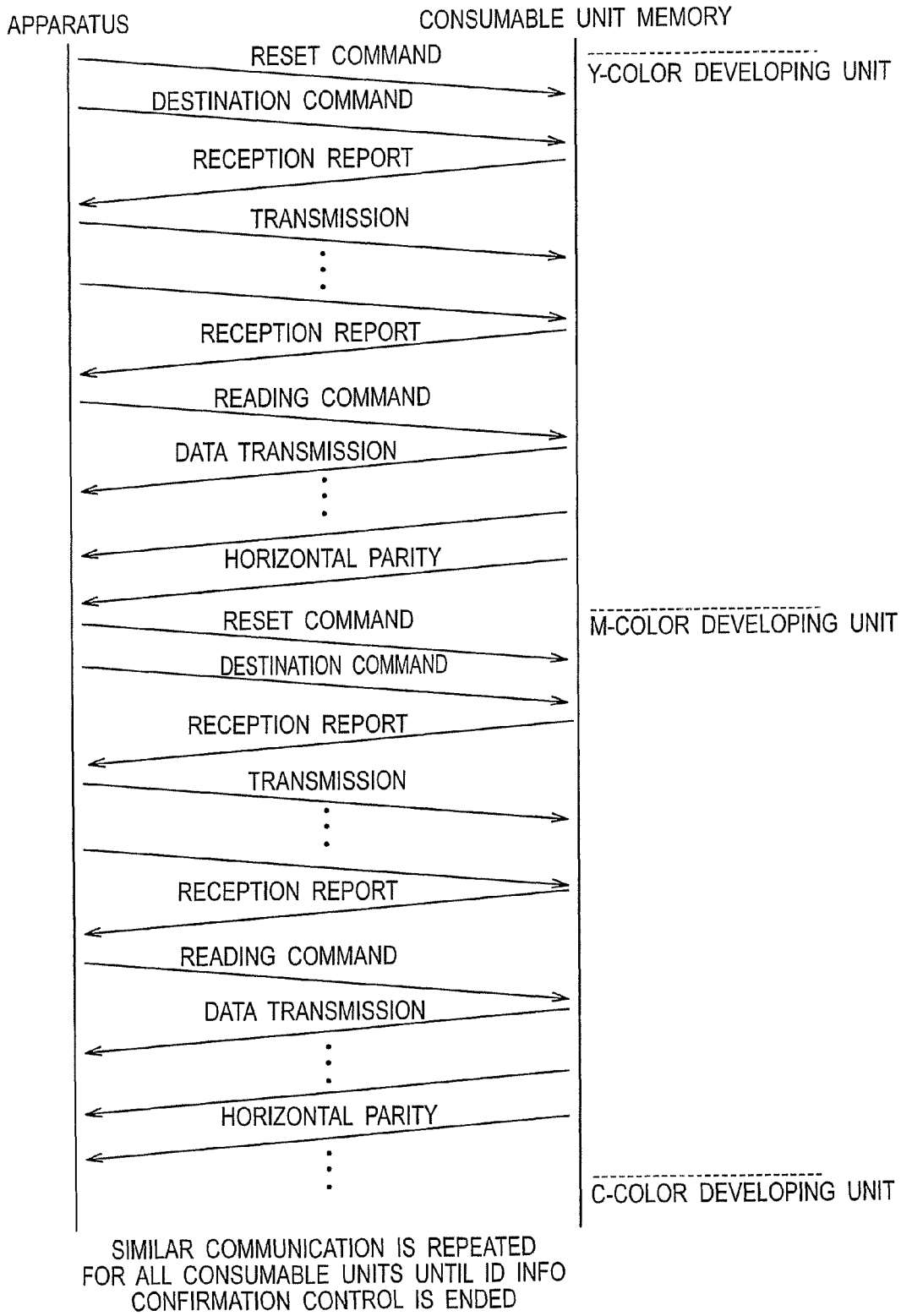
FIG. 8 is a schematic view of a communication performed when the identification information confirmation control is executed.

The attachment judging part 108 causes the attachment judging control to judge whether the same developing unit 18 or toner cartridge 28 as that before the print mode is set in the unprintable state is attached to the apparatus 2, when the recovering operation (e.g., operation of turning on power supply, operation of clearing a power saving state, and operation of closing the front door 100 of the apparatus 2) having possibility that the developing unit 18 or the toner cartridge 28 is replaced, after the print mode is set in the print inoperable state. Description will be given for the attachment judging control later (FIGS. 6 to 10). The identification information confirmation part 110 included in the attachment judging part 108 executes identification information confirmation control for confirming whether the identification information of the developing unit 18 or the toner cartridge 28 read by the information reader 106 after the recovering operation, coincides with the identification information of the developing unit 18 or the toner cartridge 28 memorized in the second nonvolatile memory 66. The identification information confirmation control will be described later (FIGS. 7 and 8).

The image adjustment part 112 is constituted to execute image adjustment control (FIGS. 11 to 13) as will be described later.

Figure 5:
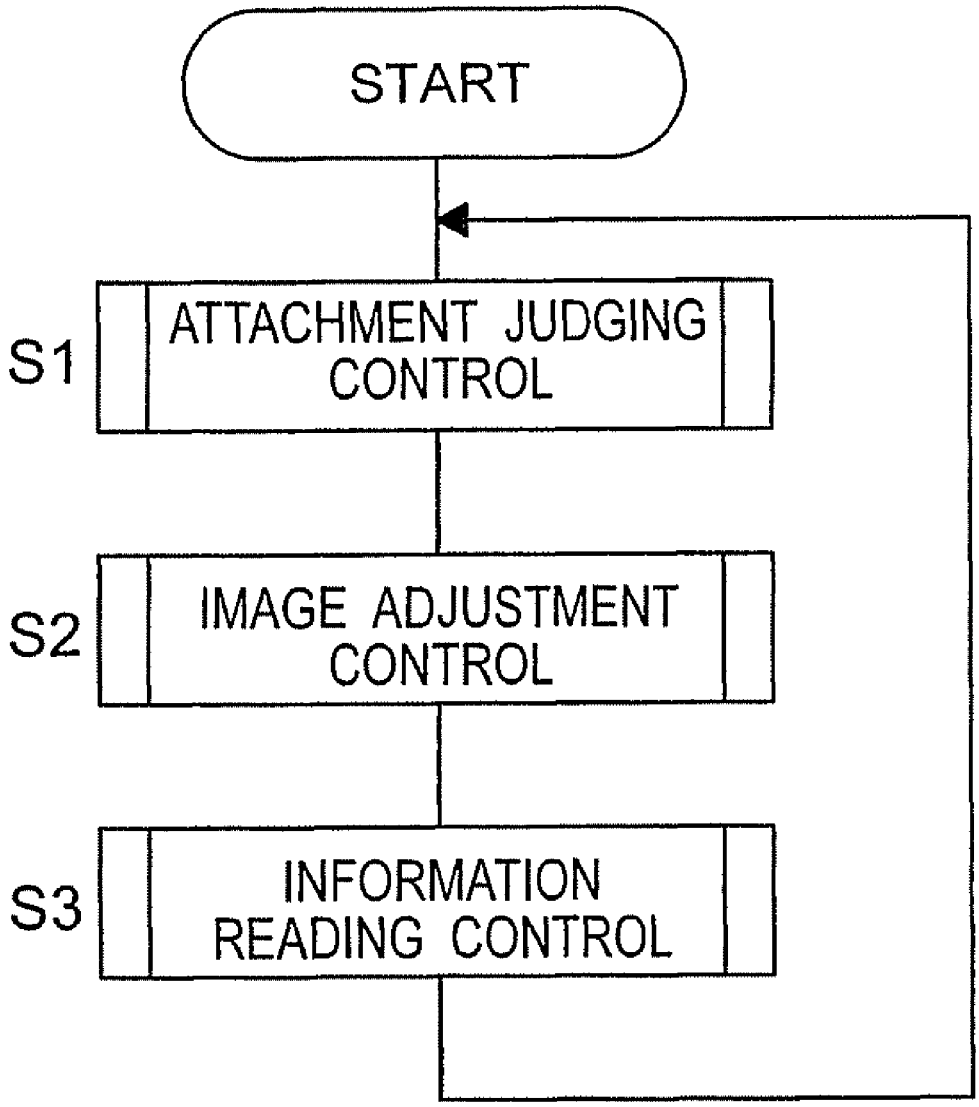
FIG. 5 is a flowchart showing a flow of processing of a main routine.

FIG. 5 is a flowchart showing a flow of the processing of a control of main routine executed after the recovering operation.

As shown in FIG. 5, first, in step S1, the attachment judging control as will be described later (FIG. 6 to FIG. 10) is executed by the attachment judging part 108. At this time, a part of the information memorized in the nonvolatile memories 80 and 88 of the developing unit 18 or the toner cartridge 28 is read by the information reader 106. The processing of the step S1 is sequentially executed for the developing unit 18 of each color and the toner cartridge 28 of each color.

In the next step S2, the image adjustment control as will be described later (FIG. 11 to FIG. 13) is executed by the image adjustment part 11.

Figure 14:
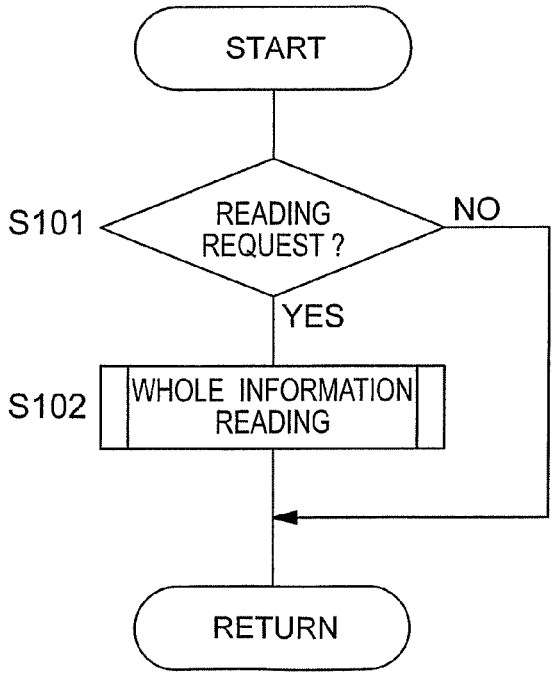
FIG. 14 is a flowchart showing the flow of the processing of information reading control.
Figure 15:
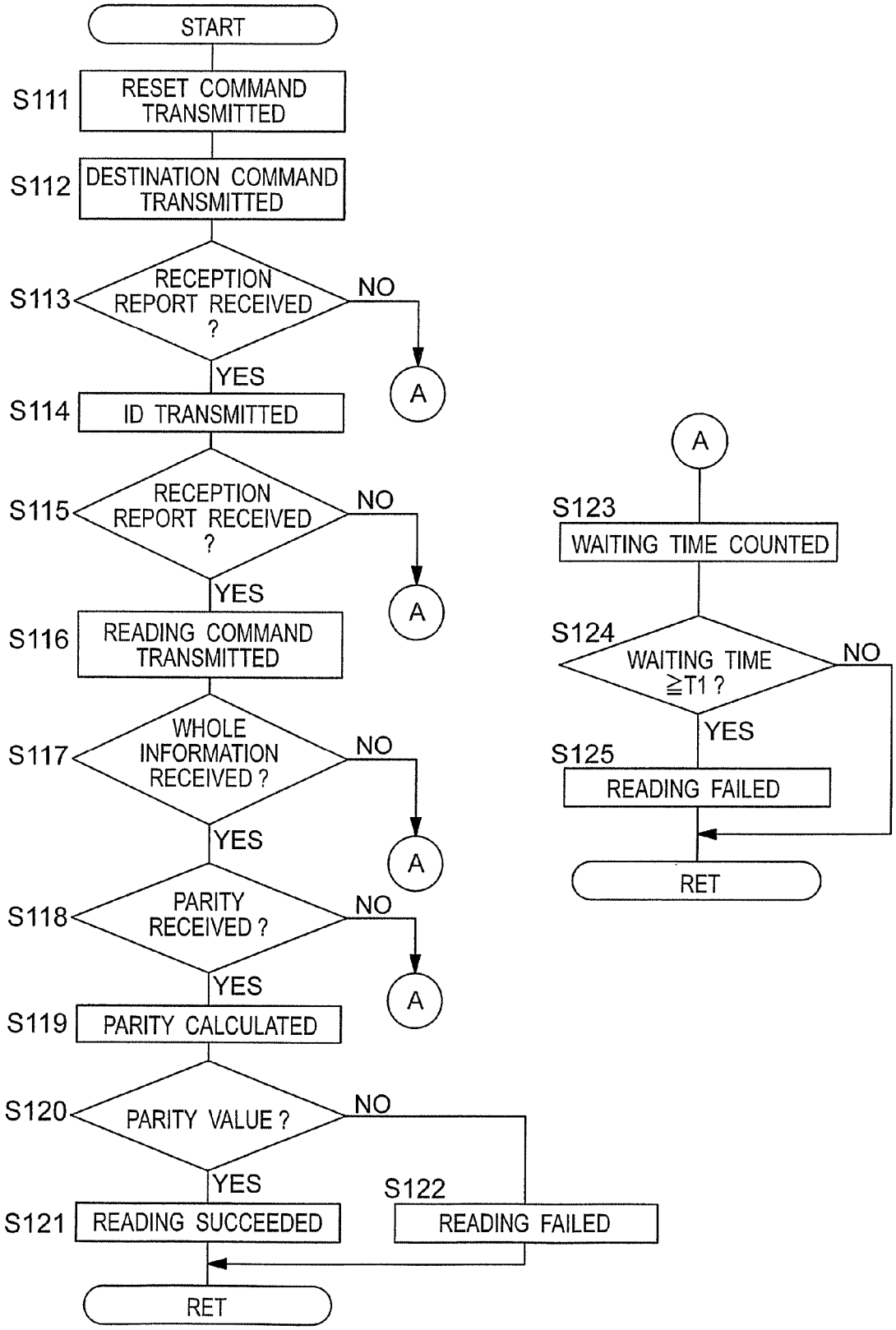
FIG. 15 is a flowchart showing the flow of the processing of whole information reading control.
Figure 16:
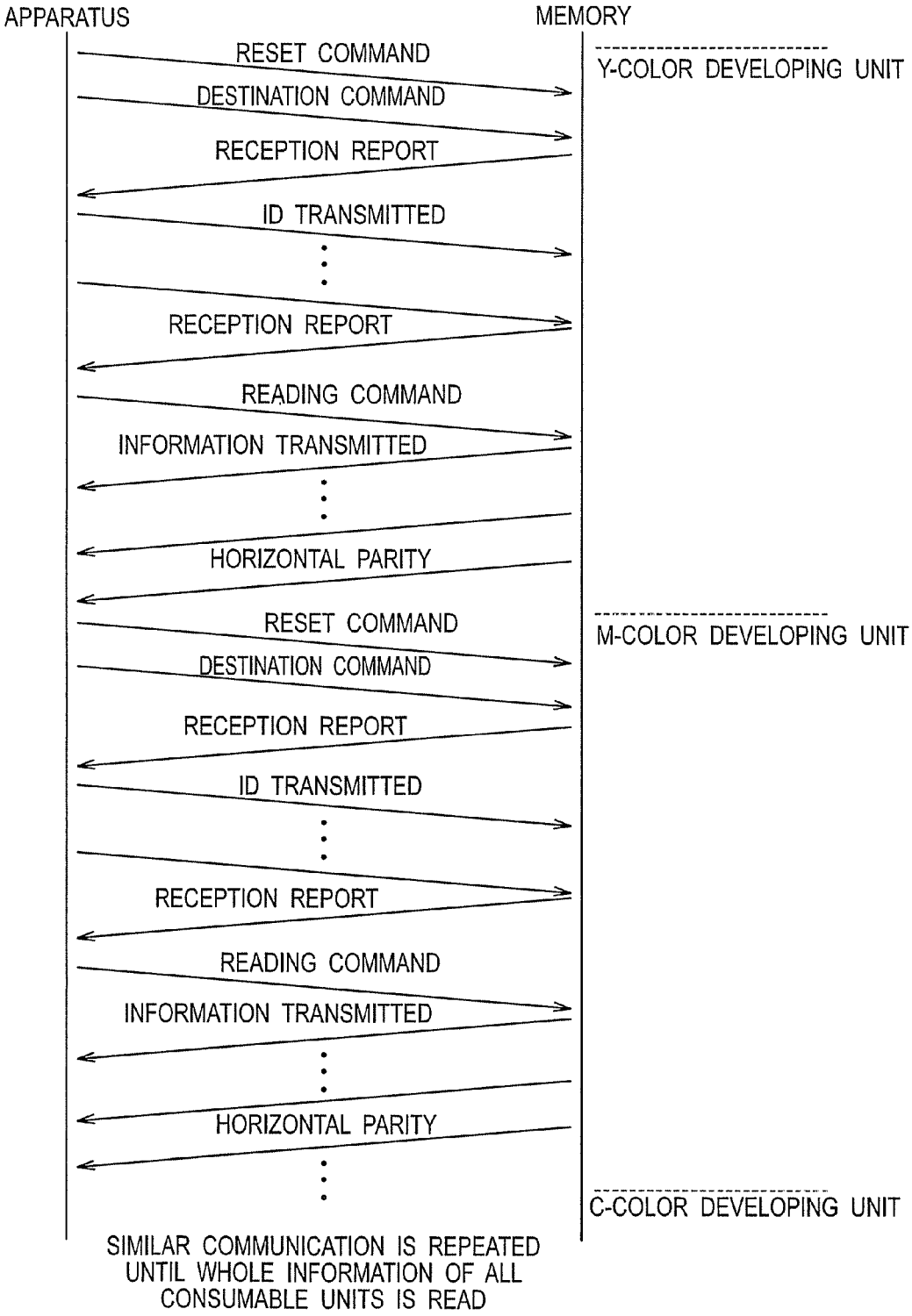
FIG. 16 is a schematic view of the communication performed when the whole information reading control is executed.
Figure 22:
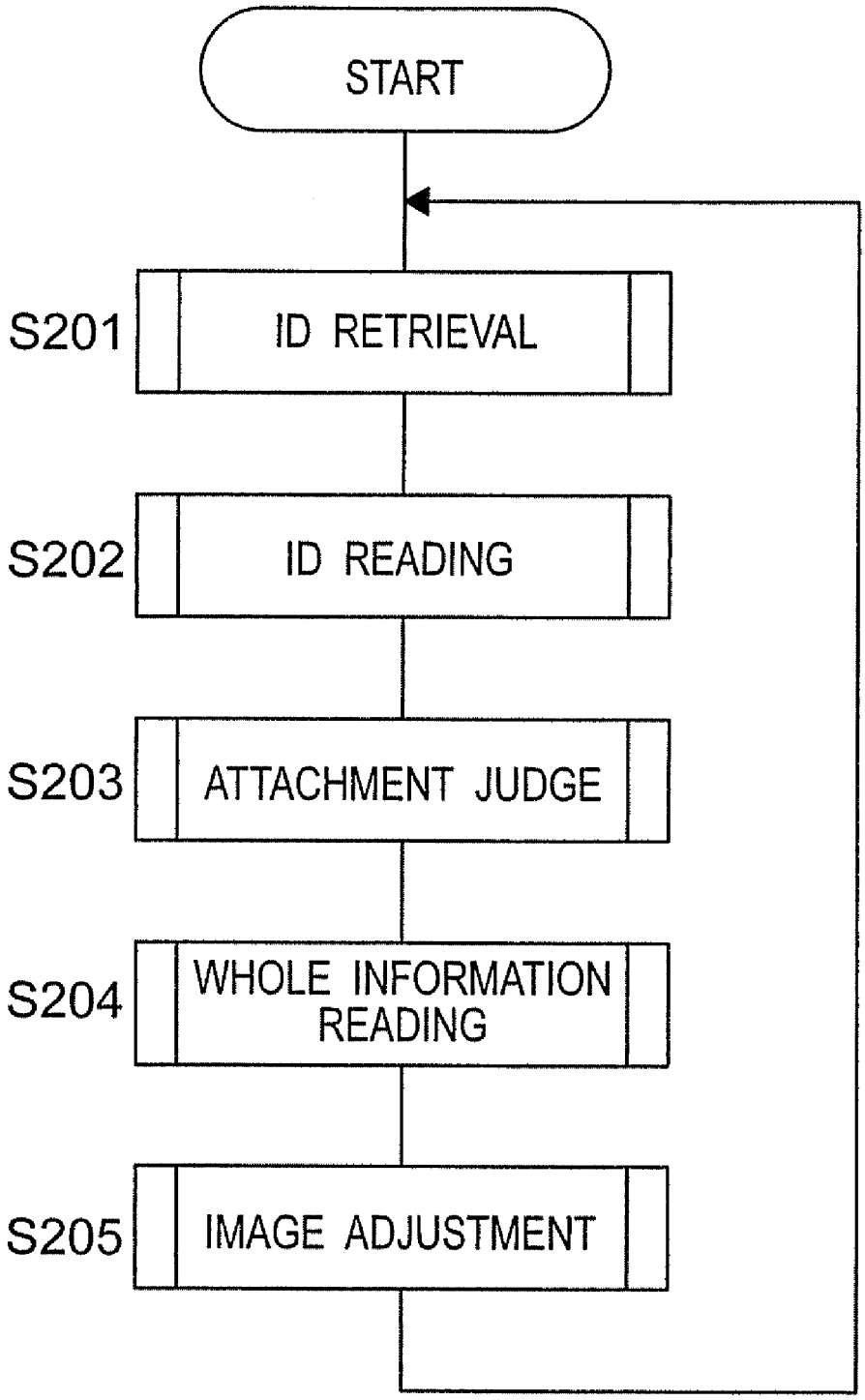
FIG. 22 is a flowchart showing the flow of the processing of a conventional main routine.

In the subsequent step S3, remaining information excluding the information read in executing the attachment judging control is read by the information reader 106, out of the information memorized in the nonvolatile memories 80 and 88 of the developing unit 18 or the toner cartridge 28 (FIG. 14 to FIG. 16). The processing of the step S3 is sequentially executed, for the developing unit 18 of each color and the toner cartridge 28 of each color. When the processing of the step S3 is completed, the processing is returned to the step S1, and similar processing is repeated thereafter.

Figure 6:
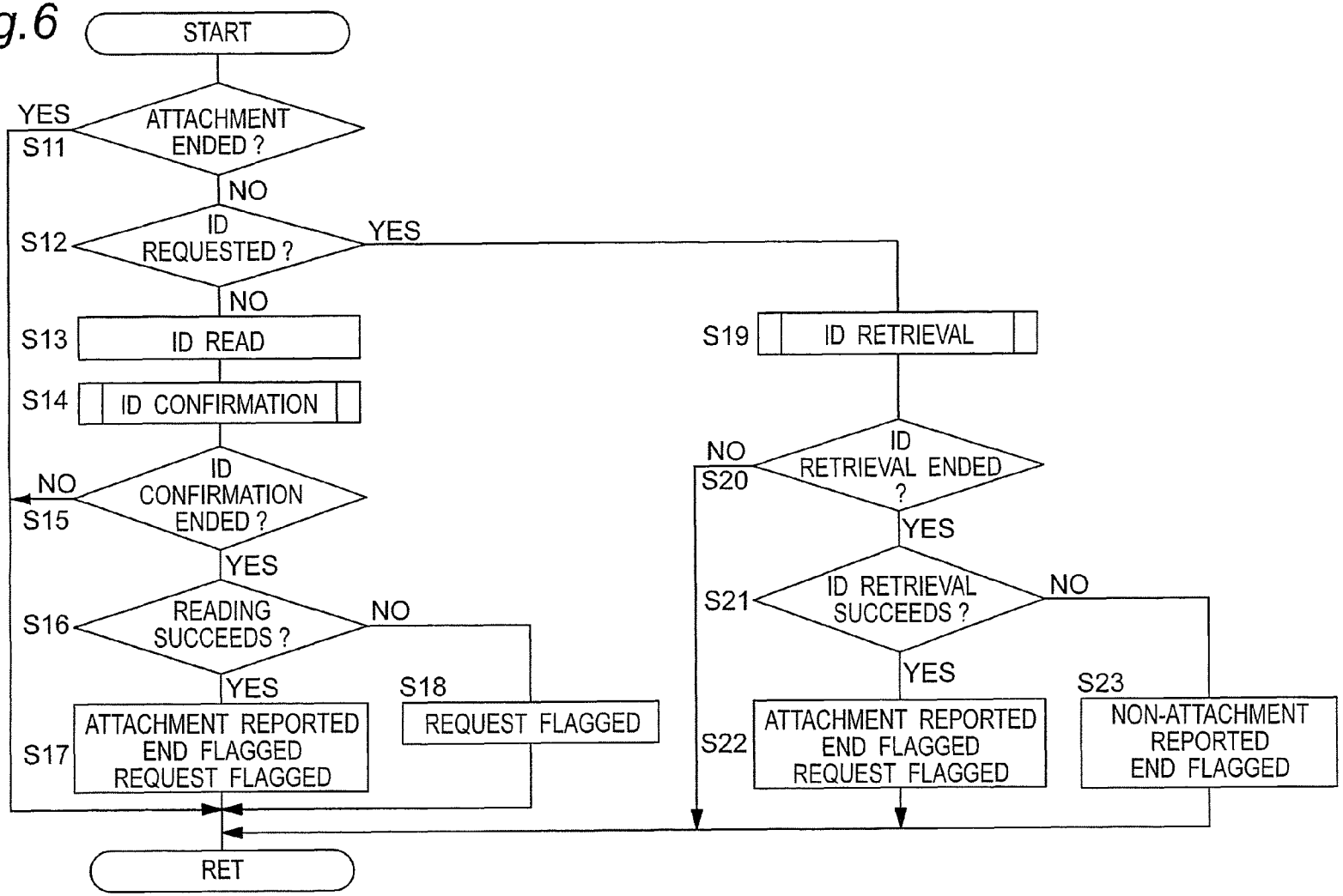
FIG. 6 is a flowchart showing the flow of the processing of attachment judging control.

FIG. 6 is a flowchart showing the flow of the processing of the attachment judging control.

As shown in FIG. 6, first, in step S11, it is determined whether the attachment judging control is completed. In step S11, when it is determined that the attachment judging control is not completed, the processing is proceeded to step S12, and when it is determined that the attachment judging control is completed, the processing is returned to main routine (FIG. 5).

In step S12, it is determined whether there is a request of identification information retrieval for retrieving the identification information of the developing unit 18 or the toner cartridge 28. In step S12, when it is determined that there is no request of the identification information retrieval, the processing is proceeded to step S13, and when it is determined that there is the request of the identification information retrieval, the processing is proceeded to step S19.

In step S13, the identification information of the developing unit 18 or the toner cartridge 28 memorized in the nonvolatile memory 66 is read, and the processing is proceeded to step S14.

In step S14, based on the identification information read In step S13, the identification information confirmation control is executed, and the processing is proceeded to step S15. The identification information confirmation control will be described later (FIG. 7 and FIG. 8).

In step S15, it is determined whether the identification information confirmation control is completed. In step S15, when it is determined that the identification information confirmation control is completed, the processing is proceeded to step S16, and when it is determined that the identification information confirmation control is not completed, the processing is returned to main routine.

In step S16, it is determined whether reading of sector 8 succeeds, performed in the identification information confirmation control of the step S14. In step S16, when it is determined that the reading succeeds, the processing is proceeded to step S17, and when it is determined that the reading fails, the processing is proceeded to step S18.

In step S17, the information shows that the same developing unit 18 or the toner cartridge 28 as that before the print mode is set in the unprintable state is attached to the apparatus 2, and this information is reported to the operation display 60. Then, the end of the attachment judging control is flagged, and the request to read the remaining information (information reading request) excluding the read information in performing attachment judging control is flagged, and the processing is returned to the main routine.

In step S18, it can be estimated that the developing unit 18 or the toner cartridge 28 is replaced, or they are not attached to the apparatus 2. Therefore, the request to retrieve the identification information is flagged, and the processing is returned to the main routine.

Figure 9:
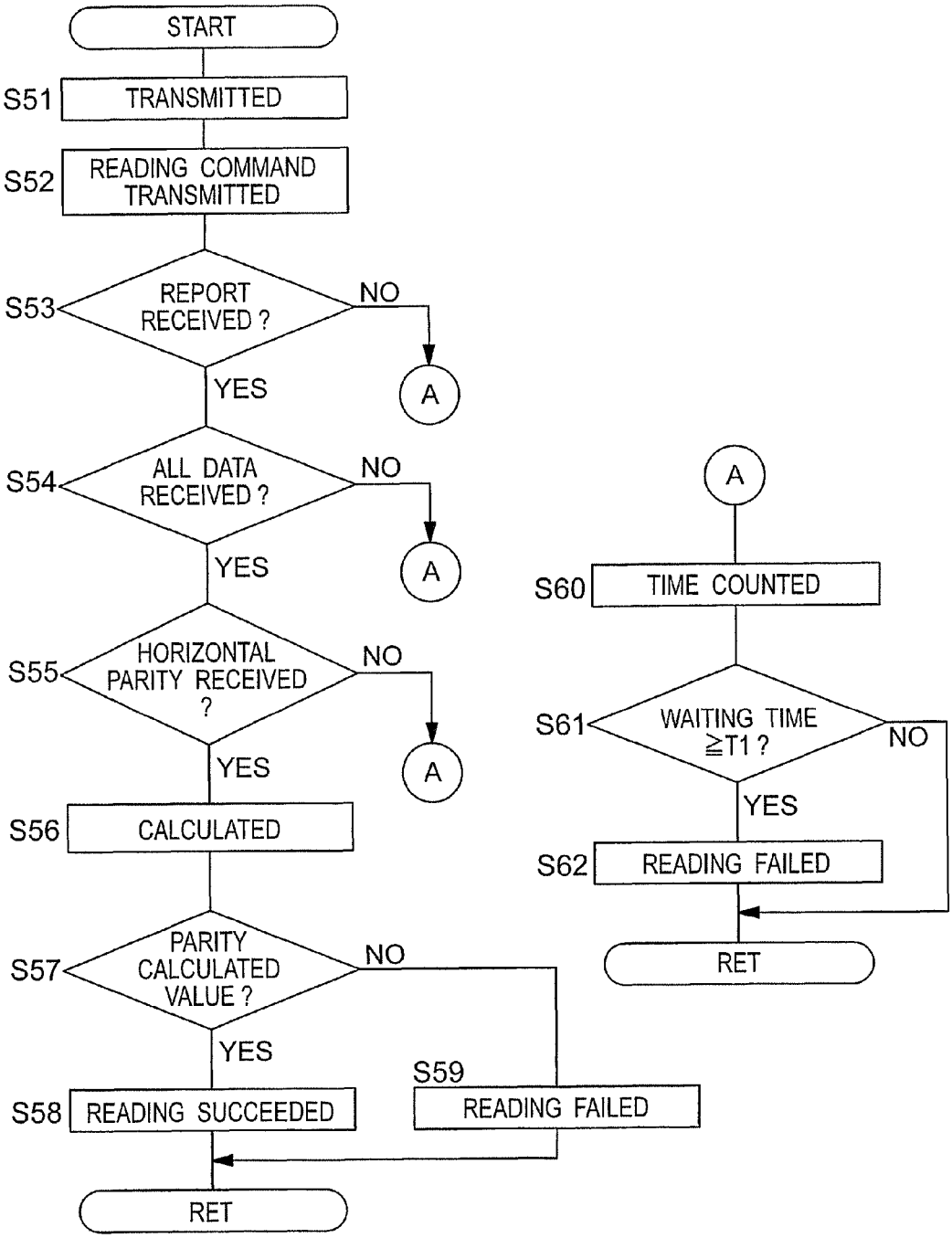
FIG. 9 is a flowchart showing the flow of the processing of identification information retrieval.
Figure 10:
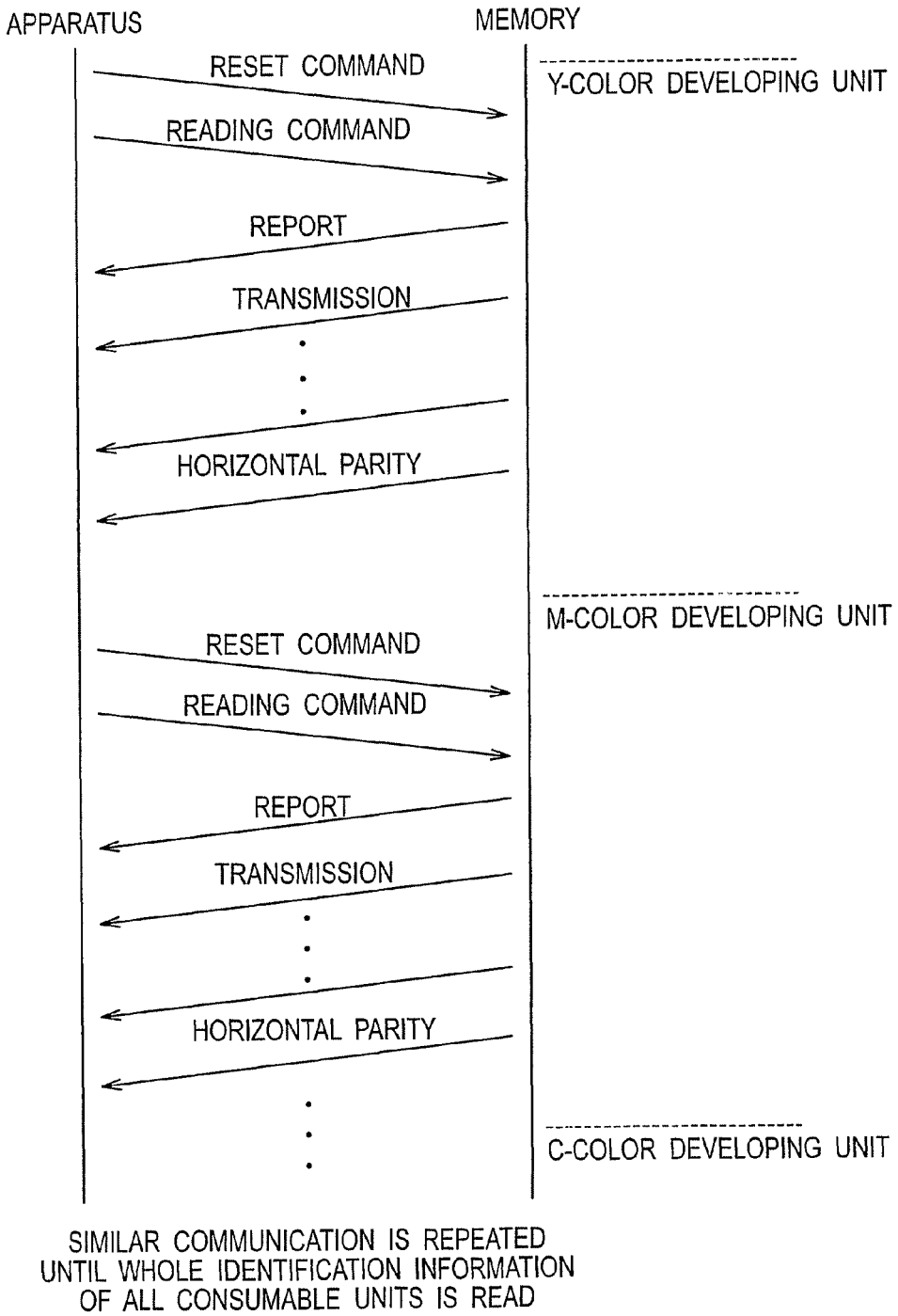
FIG. 10 is a schematic view of the communication performed when the identification information retrieval is executed.

In step S19, retrieval of the identification information is executed, and the processing is proceeded to step S20. The identification information retrieval will be described later (FIG. 9 and FIG. 10).

In step S20, whether the identification information retrieval is completed is determined. In step S20, when it is determined that the identification information retrieval is completed, the processing is proceeded to step S21, and when it is determined that the identification information retrieval is not completed, the processing is returned to the main routine.

In step S21, it is determined whether the identification information retrieval succeeds. In step S21, when it is determined that the identification information retrieval succeeds, the processing is proceeded to step S22, and when it is determined that the identification information retrieval fails, the processing is proceeded to step S23.

In step S22, the information, showing that the developing unit 18 or the toner cartridge 28 after replacement is attached to the apparatus 2, is reported to the operation display 60. Then, the end of the attachment judging control is flagged and the request to read the information is flagged, and the processing is returned to the main routine.

In step S23, the information, showing that the developing unit 18 or the toner cartridge 28 is not attached to the apparatus 2, is reported to the operation display 60, and the end of the attachment judging control is flagged, and the processing is returned to the main routine.

FIG. 7 is a flowchart showing the flow of the processing of the identification information confirmation control, and FIG. 8 is a schematic view of a communication performed when the identification information confirmation control is executed.

As shown in FIG. 7, in the identification information confirmation control, in step S31 first, in order to report the start of a new communication sequence to the nonvolatile memories 80 and 88, a reset command is transmitted to the bus 103 from the overall controller 68.

In the next step S32, a communication destination designating command for designating the nonvolatile memories 80 and 88, being communication destinations of the overall controller 68, is transmitted to the bus 103 from the overall controller 68. The designated nonvolatile memories 80 and 88 return a reception report, upon the receipt of the communication destination command (FIG. 8).

In the subsequent step S33, it is determined whether the reception report to the communication destination designating command is received by the overall controller 68. In step S33, when it is determined that the reception report is received, the processing is proceeded to step S34, and when it is determined that the reception report is not received, the processing is proceeded to step S43.

In step S34, the identification information of the developing unit 18 or the toner cartridge 28 memorized in the second nonvolatile memory 66 is transmitted to the bus 103, and the processing is proceeded to step S35. The nonvolatile memories 80 and 88 of the communication destination return the identification information reception report, upon the receipt of the identification information (FIG. 8).

In step S35, it is determined whether the identification information reception report is received by the overall controller 68. In step S35, when it is determined that the identification information reception report is received, the processing is proceeded to step S36, and when it is determined that the identification information reception report is not received, the processing is proceeded to step S43.

In step S36, a sector 8 reading command is transmitted to the bus 103, and the processing is proceeded to step S37. When the sector 8 reading command is received, the nonvolatile memories 80 and 88 of the communication destination transmit the data of the sector 8 (8 bytes) and the horizontal parity of the data (FIG. 8).

In step S37, it is determined whether the data of 8 bytes is received in the overall controller 68. In step S37, when it is determined that the data is received, the processing is proceeded to step S38, and when it is determined that the data is not received, the processing is proceeded to step S43.

In step S38, it is determined whether the horizontal parity of the sector 8 is received in the overall controller 68. In step S38, when it is determined that the horizontal parity is received, the processing is proceeded to step S39, and when it is determined that the horizontal parity is not received, the processing is proceeded to step S43.

In step S39, the horizontal parity of the data of 8 bytes received by the overall controller 68 is calculated, and the processing is proceeded to step S40.

In step S40, it is determined whether a calculated value of the received horizontal parity and the calculated value of the horizontal parity obtained by calculation of step S39 coincide with each other. In step S40, when it is determined that they coincide with each other, the processing is proceeded to step S41, and when it is determined that they do not coincide with each other, the processing is proceeded to step S42.

In step S41, it is determined that reading of the sector 8 succeeds, and the processing is returned to a routine of the attachment judging control (FIG. 6). The sector 8 includes new/old unit information (FIG. 20) required for the image adjustment control (FIG. 11) as will be described later. Therefore, when reading of the sector 8 succeeds, the image adjustment control can be properly executed. In addition, in the identification information confirmation control, reading of the data other than the sector 8 is not performed. Therefore, the time required for the attachment judging control including the identification information confirmation control can be shortened.

In step S42, it is determined that reading of the sector 8 fails, and the processing is returned to the routine of the attachment judging control (FIG. 6).

In step S43, count of a reception waiting time from the designated nonvolatile memories 80 and 88 is started, and the processing is proceeded to step S44.

In step S44, it is determined whether the reception waiting time reaches a prescribed time T1 or more. In step S44, when it is determined that the reception waiting time reaches the prescribed time T1 or more, it is determined that the reading of the sector 8 fails in step S45, and then the processing is returned to the routine of the attachment judging control (FIG. 6). In step S44, when it is determined that the reception waiting time is under the prescribed time T1, count of the reception waiting time is continued until the prescribed time T1, unless there is reception from the nonvolatile memories 80 and 88.

In the communication of the identification information confirmation control, the reading command of the sector 8 designates the consumable unit (developing unit 18 or the toner cartridge 28) by lower-order 3 bit of the character bit of a second byte, and designates the sector 8 by upper-order 3 bit of the character bit of the second byte (see FIG. 19).

FIG. 9 is a flowchart showing the flow of the processing of the identification information retrieval, and FIG. 10 is a schematic view of the communication performed for retrieving the identification information.

As shown in FIG. 9, in the identification information retrieval, first, in step S51, in order to report the start of a new communication sequence to the nonvolatile memories 80 and 88, the reset command is transmitted to the bus 103 from the overall controller 68.

In the next step S52, the identification information reading command is transmitted to the bus 103 from the overall controller 68. When the identification information reading command is received, the nonvolatile memories 80 and 88 return an identification information report, and subsequently return the identification information and its horizontal parity (FIG. 10).

In the subsequent step S53, it is determined whether the identification information report is received by the overall controller 68. In step S53, when it is determined that the identification information report is received, the processing is proceeded to step S54, and when it is determined that the identification information report is not received, the processing is proceeded to step S60.

In step S54, whether the whole identification information is received is determined. In step S54, when it is determined that the whole identification information is received, the processing is proceeded to step S55, and when it is determined that the whole identification information is not received, the processing is proceeded to step S60.

In step S55, it is determined whether the horizontal parity of the identification information is received. In step S55, when it is determined that the horizontal parity is received, the processing is proceeded to step S56, and when it is determined that the horizontal parity is not received, the processing is proceeded to the step S60.

In step S56, the horizontal parity of the identification information received by the overall controller 68 is calculated, and the processing is proceeded to step S57.

In step S57, it is determined whether the calculated value of the received horizontal parity and the calculated value of the horizontal parity obtained by calculation of the step S56 coincide with each other. In step S57, when it is determined that they coincide with each other, the processing is proceeded to step S58, and when it is determined that they do not coincide with each other, the processing is proceeded to step S59.

In step S58, it is determined that the reading of the identification information succeeds, and the processing is returned to the routine of the attachment judging control (FIG. 6).

In step S59, it is determined that the reading of the identification information fails, and the processing is returned to the routine of the attachment judging control (FIG. 6).

In step S60, a counting of the reception waiting time from the designated nonvolatile memories 80 and 88 is started, and the processing is proceeded to step S61.

In step S61, it is determined whether the reception waiting time reaches the prescribed time T1. In step S61, when it is determined that the reception waiting time reaches the prescribed time T1 or more, it is determined that the reading of the identification information fails in step S62, and thereafter the processing is returned to the routine of the attachment judging control (FIG. 6). In step S61, when it is determined that the reception waiting time is under the prescribed time T1, the counting of the reception waiting time is continued until the prescribed time T1, unless there is reception from the nonvolatile memories 80 and 88.

In the communication of the identification information retrieval, the identification information reading command and the identification information report designates the consumable unit (developing unit 18 or the toner cartridge 28) by lower-order 3 bit of the character bit of the second byte (see FIG. 19).

Figure 11:
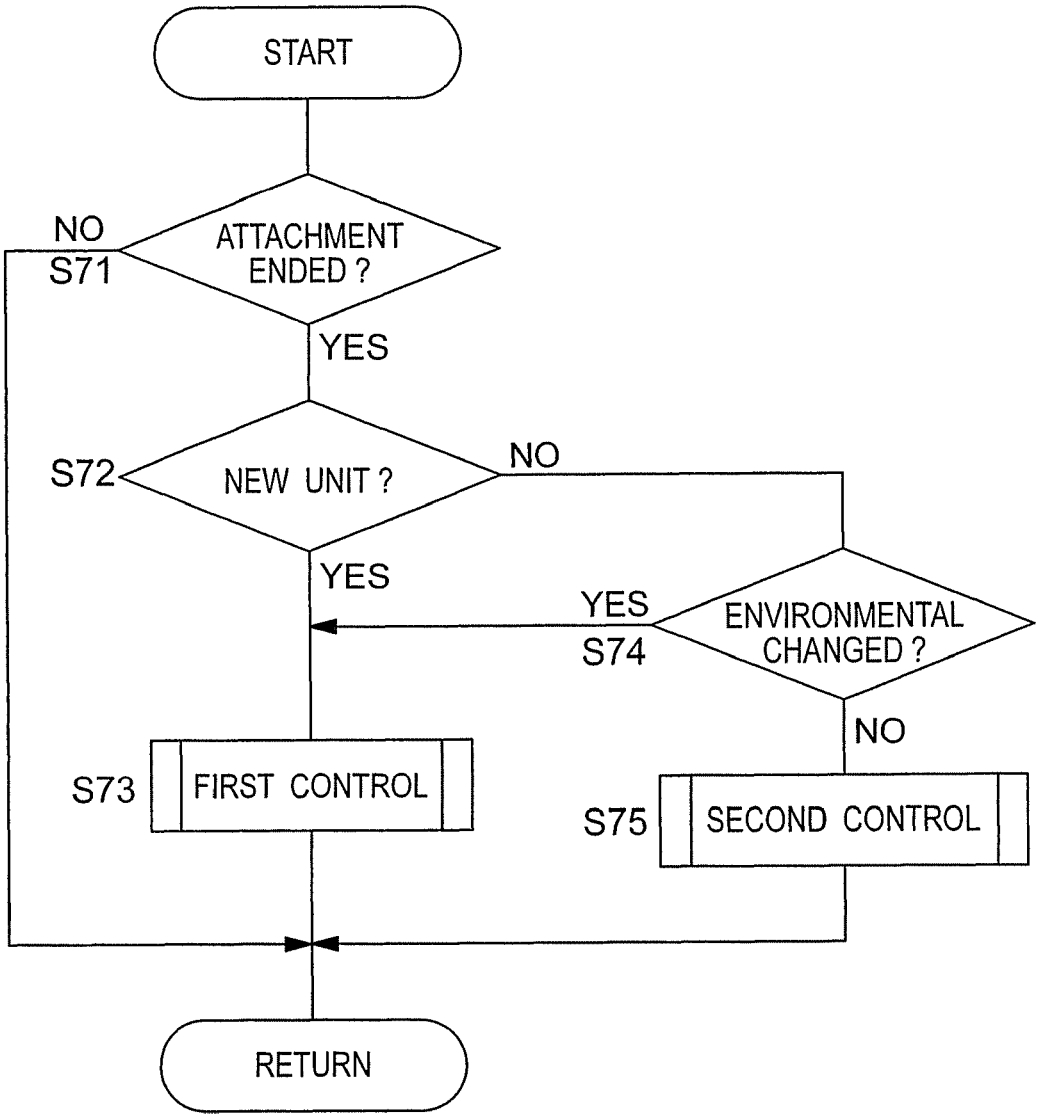
FIG. 11 is a flowchart showing the flow of the processing of image adjustment control.

FIG. 11 is a flowchart showing the flow of each processing, regarding the image adjustment control performed subsequently to the attachment judging control in the main routine (FIG. 5).

As shown in FIG. 11, first, in step S71, it is determined whether the attachment judging control is completed. In step S71, when it is determined that the attachment judging control is completed, the processing is proceeded to step S72, and when it is determined that the attachment judging control is not completed, the processing is returned to the main routine (FIG. 5).

In step S72, it is determined whether a new consumable unit (the developing unit 18 or the toner cartridge 28) is attached to the image forming apparatus 2. The judgment is performed based on new/old unit information memorized in the sector 8 (address 64) of the nonvolatile memories 80 and 88. In step S72, when it is determined that the new consumable unit is attached to the apparatus 2, the processing is proceeded to step S73, and when it is determined that the new consumable unit is not attached to the apparatus 2, the processing is proceeded to step S74.

In step S74, it is determined whether temperature and humidity environment inside of the apparatus 2 is changed, compared to that of an attachment state of the consumable unit. In step S74, when it is determined that the temperature and humidity environment is changed, the processing is proceeded to the step S73, and when it is determined that the temperature and humidity environment is not changed, the processing is proceeded to step S75.

In step S73, after the first image adjustment control as will be described later is executed, the processing is returned to the main routine.

In step S75, after the second image adjustment control as will be described later is executed, the processing is returned to the main routine.

Figure 12:
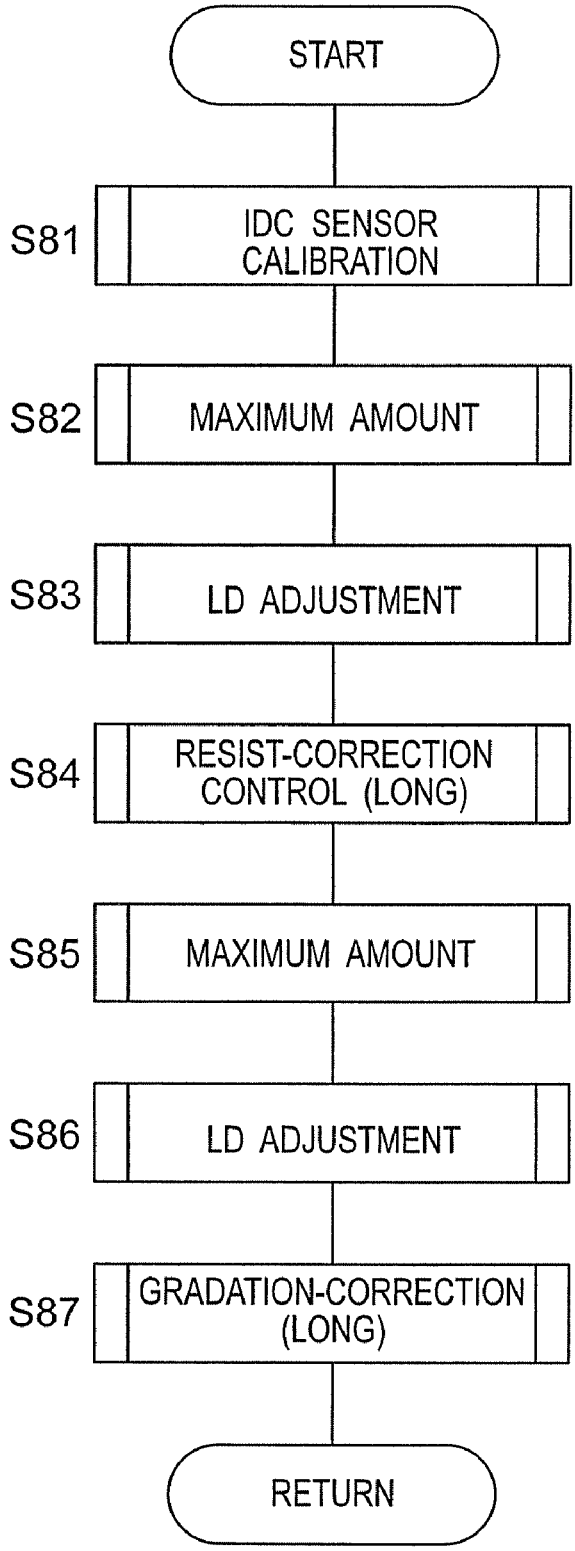
FIG. 12 is a flowchart showing the flow of the processing of a first image adjustment control.

As shown in FIG. 12, in the first image adjustment control, control of calibrating an IDC (Image Density Control) sensor (step S81), control of adjusting a maximum amount of toner to be attached to the intermediate transfer belt 30 (step S82), control of adjusting light quantity of a laser diode (LD) (step S83), control of performing resist-correction (step S84), control of adjusting the maximum amount of toner to be attached to the intermediate transfer belt 30 (second time) (step S85), control of adjusting the light quantity of the laser diode (LD) (second time) (step S86), and control of performing gradation-correction (step S87) are sequentially executed.

Figure 13:
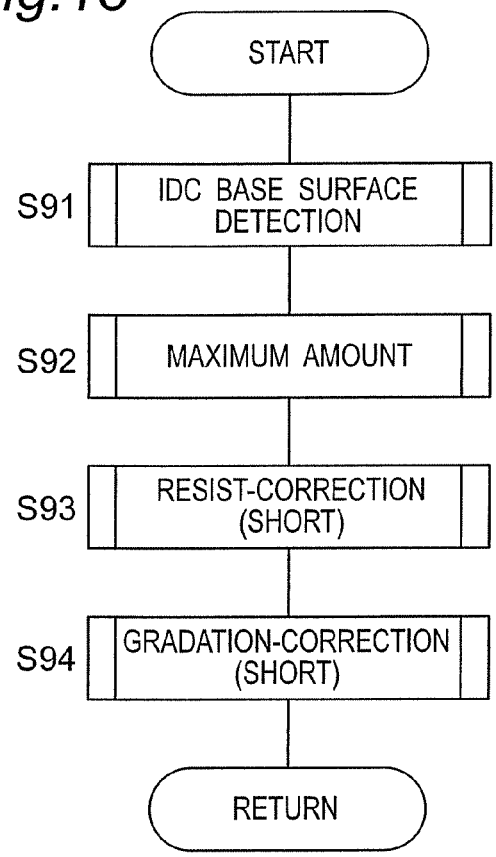
FIG. 13 is a flowchart showing the flow of the processing of a second image adjustment control.

As shown in FIG. 13, the second image adjustment control is a control executed when no consumable unit is replaced and no change of temperature and humidity environment occurs. Therefore, the second image adjustment control is simplified, compared to the first image adjustment control. Specifically, control of detecting a base surface of the IDC sensor (step S91), control of adjusting the maximum amount of toner to be attached to the intermediate transfer belt 30 (step S92), control of performing resist-correction (step S93), control of performing gradation-correction (step S94) are sequentially executed. The control of detecting the base surface of the IDC sensor of the second image adjustment control (step S91) is more simple than the control of calibrating the IDC sensor of the first image adjustment control (step S81 of FIG. 12). In addition, the time required for the processing of step S93 of the second image adjustment control is shorter than the processing of step S84 of the first image adjustment control, and the time required for the processing of step S94 of the second image adjustment control is shorter than the processing of step S87 of the first image adjustment control. Further, the number of times of processing of the second image adjustment control is less than that of the first image adjustment control, which significantly contributes to the shortening of a standby time for printing.

FIG. 14 is a flowchart showing the flow of each processing, regarding information reading control performed in parallel to the image adjustment control in the main routine (FIG. 5).

As shown in FIG. 14, first, in step S101, it is determined whether an image reading request is given in the attachment judging control (FIG. 6). In step S101, when it is determined that the information reading request is given, the processing is proceeded to step S102, and when it is determined that the information reading request is not given, the processing is returned to the main routine.

In step S102, whole information reading control is executed, and the processing is returned to the main routine. The whole information specified here is the remaining information excluding the information read by the attachment judging control, out of the information memorized in the nonvolatile memories 80 and 88 (the same thing can be the hereunder).

FIG. 15 is a flowchart showing the flow of each processing of the whole information reading control. FIG. 16 is a schematic view of the communication performed when whole information reading control is performed.

As shown in FIG. 15, in the whole information reading control, first, in step S111, in order to report to the nonvolatile memories 80 and 88, regarding the start of a new communication sequence, the reset command is transmitted from the overall controller 68 to the bus 103.

In the next step S112, communication destination designating command for designating the nonvolatile memories 80 and 88, being the communication destinations of the overall controller 68, is transmitted to the bus 103 from the overall controller 68. When the communication destination designating command is received, the designated nonvolatile memories 80 and 88 return the reception report (FIG. 16).

In the subsequent step S113, it is determined whether the reception report to the communication destination designating command is received by the overall controller 68. In step S113, when it is determined that the reception report is received, the processing is proceeded to step C34, and when it is determined that the reception report is not received, the processing is proceeded to step S123.

In step S114, the identification information of the developing unit 18 or the toner cartridge 28 memorized in the second nonvolatile memory 66 is transmitted to the bus 103, and the processing is proceeded to step S115. When the identification information is received, the nonvolatile memories 80 and 88 of the communication destination return the identification information reception report (FIG. 16).

In step S115, whether the identification information reception report is received by the overall controller 68 is determined. In step S115, when it is determined that the identification information reception report is received, the processing is proceeded to step S116, and when it is determined that the identification information reception report is not received, the processing is proceeded to step S123.

In step S116, the whole information reading command is transmitted to the bus 103, and the processing is proceeded to step S117. When the whole information reading command is received, the nonvolatile memories 80 and 88 of the communication destination transmit the data of the whole information data and the horizontal parity of the data (FIG. 16).

In step S117, it is determined whether the data of the whole information is received by the overall controller 68. In step S117, when it is determined that the data of the whole information is received, the processing is proceeded to step S118, and when it is determined that it is not received, the processing is proceeded to step S123.

In step S118, it is determined whether the horizontal parity of the data of the whole information is received by the overall controller 68. In step S118, when it is determined that the horizontal parity is received, the processing is proceeded to step S119, and when it is determined that the horizontal parity is not received, the processing is proceeded to step S123.

In step S119, the horizontal parity of the data of the whole information received by the overall controller 68 is calculated and the processing is proceeded to step S120.

In step S120, it is determined whether the calculated values of the received horizontal parity and the horizontal parity obtained by calculation of step S119 coincide with each other. In step S120, when it is determined that they coincide with each other, the processing is proceeded to step S121, and when it is determined that they do not coincide with each other, the processing is proceeded to step S122.

In step S121, it is determined that reading of the whole information succeeds, and the processing is returned to the routine of the information reading control (FIG. 14).

In step S122, it is determined that the reading of the whole information fails, and the processing is returned to the routine of the information reading control (FIG. 14).

In step S123, count of the reception waiting time from the designated nonvolatile memories 80 and 88 is started, and the processing is proceeded to step S124.

In step S124, it is determined whether the reception waiting time reaches the prescribed time T1. In step S124, when it is determined that the reception waiting time reaches the prescribed time T1, the processing is returned to the routine (FIG. 14) of the information reading control, after it is determined that reading of the whole information fails In step S125. In step S124, when it is determined that the reception waiting time is under the prescribed time T1, count of the reception waiting time is continued until it reaches the prescribed time T1, unless there is reception from the nonvolatile memories 80 and 88.

In the communication of the whole information reading control, the whole information reading command designates the consumable unit (developing unit 18 or the toner cartridge 28), by lower-order 3 bit of the character bit of the second byte (see FIG. 19).

Although the present invention has been described with reference to the aforementioned embodiments, the present invention is not limited to the aforementioned embodiments.

For example, in the aforementioned embodiments, a description is given for the attachment judging of the developing unit 18 or the toner cartridge 28. However, the present invention can be equally applied to the attachment judging of the consumable unit, in addition to the developing unit 18 and the toner cartridge 28.

What is claimed is:

1. An image forming apparatus, comprising:

consumable units detachably mounted in the image forming apparatus;

first nonvolatile memories, each of the first nonvolatile memories being disposed in a respective one of the consumable units for memorizing various information including identification information of the respective consumable unit;

an information reader which reads information memorized in the first nonvolatile memories when the consumable units are attached to the image forming apparatus;

a second nonvolatile memory connected to the first nonvolatile memories via a same bus for memorizing the information read by the information reader; and an attachment judging part which executes an attachment judging control for judging whether the same consumable unit as that before a print mode is set in an unprintable state, is attached to the image forming apparatus, when a recovering operation having a possibility of replacing the consumable unit is performed after the print mode is set in the unprintable state, the attachment judging part transmitting to the bus a signal based on the information of the respective consumable unit memorized in the second nonvolatile memory, and judging that the same consumable unit as that before the print mode is set in the unprintable state is attached to the image forming apparatus, when there is a reply thereto regarding a part of the information in the first nonvolatile memory;

wherein in the attachment judging control, the part of the information read from the first nonvolatile memory by the information reader is the information for image adjustment required when image adjustment control is performed;

and further comprising an image adjustment part that executes image adjustment control, wherein the image adjustment part executes image adjustment control, based on the information for image adjustment read by the information reader when the attachment judging control is performed after the recovering operation, and the information reader reads the remaining information excluding the information read before the image adjustment control is executed after the recovering operation is performed, out of the information memorized in the first nonvolatile memory, during executing the image adjustment control, after the recovering operation.

2. The image forming apparatus according to claim 1, wherein the information for image adjustment includes the information showing whether the consumable unit is new.

3. The image forming apparatus according to claim 1, wherein when the information for image adjustment cannot be read by the information reader after the recovering operation, the attachment judging part transmits to the bus a signal for requesting a reply of the identification information, and thereafter when the identification information is replied from the first nonvolatile memory, judges that the consumable unit is replaced in a period from the unprintable state to executing the recovering operation, and the information reader reads the information for image adjustment memorized in the first nonvolatile memory, when the attachment judging part so determined that the consumable unit is replaced, and the image adjustment part executes image adjustment based on the information for image adjustment, when the attachment judging part so judges that the consumable unit is replaced.

4. The image forming apparatus according to claim 1, wherein when the information for image adjustment cannot be read by the information reader after the recovering operation, the attachment judging part transmits to the bus the signal for requesting the reply of the identification information and thereafter when the identification information is not replied from the first nonvolatile memory, judges that the consumable unit is not attached to the image forming apparatus.

5. An image forming method, comprising:

a memorizing step of memorizing information of a consumable unit memorized in a first nonvolatile memory of the consumable unit, in a second nonvolatile memory of an image forming apparatus, in a state of attaching the consumable unit to the image forming apparatus;

a rememorizing step of performing recovering operation having a possibility of replacing the consumable unit after a print mode is set in an unprintable state;

an attachment judging step of judging whether the same consumable unit as that before the print mode is set in the unprintable state is attached to the image forming apparatus, after the rememorizing step, in the attachment judging step, a signal based on the information of the consumable unit memorized in the second nonvolatile memory being transmitted to a bus connected to the first nonvolatile memories, and when there is a reply thereto regarding a part of the information in the first nonvolatile memory, judgment being made that the same consumable unit as that before the print mode is set in the unprintable state is attached to the image forming apparatus, wherein the part of the information read in the attachment judging step is the information for image adjustment required when image adjustment control is performed; and an image adjusting step of executing image adjustment control, based on the information for image adjustment, wherein during execution of the image adjustment control, the remaining information is read, excluding the information read in a period from the recovering operation to executing the image adjustment control, out of the information memorized in the first nonvolatile memory.

6. The image forming method according to claim 5, wherein the information for image adjustment includes the information showing whether the consumable unit is new.

7. The image forming method according to claim 5, wherein when the information for image adjustment cannot be read in the attachment judging step, a signal for requesting a reply of the identification information is transmitted to the bus, and thereafter when the identification information is replied from the first nonvolatile memory, it is determined that the consumable unit is replaced in a period from being set in the unprintable state to executing the recovering operation, and when it is determined that the consumable unit is replaced in the attachment judging step, after such a judgment, the information for image adjustment is read from the first nonvolatile memory, and based on the information for image adjustment, the image adjustment control is executed.

8. The image forming method according to claim 5, wherein when the information for image adjustment cannot be read in the attachment judging step, the signal for requesting the reply of the identification information is transmitted to the bus, and thereafter, when the identification information is not replied from the first nonvolatile memory, it is determined that the consumable unit is not attached to the image forming apparatus.

* * * * *